United States Patent [19]

Schenz et al.

[11] Patent Number: 4,541,873

[45] Date of Patent: Sep. 17, 1985

[54] METHOD AND MANUFACTURE FOR EASILY SPRAY-DRIABLE LOW MOLECULAR WEIGHT SUGARS

[75] Inventors: Timothy W. Schenz, Haworth, N.J.; William A. Eisenhardt, Jr., Worthington, Ohio; Fouad Z. Saleeb, Pleasantville, N.Y.

[73] Assignee: General Foods Corporation, White Plains, N.Y.

[21] Appl. No.: 417,280

[22] Filed: Sep. 13, 1982

[51] Int. Cl.[4] ..... C13F 5/00

[52] U.S. Cl. ..... 127/46.1; 127/29

[58] Field of Search ..... 127/46.1, 40, 29, 61, 127/58; 536/1.1, 121, 126, 123, 124; 426/471

[56] References Cited

U.S. PATENT DOCUMENTS

| | | | |
|---|---|---|---|
| Re. 28,781 | 4/1976 | Konig | 536/121 |
| 1,807,608 | 6/1931 | Stern | 536/121 |
| 3,505,110 | 4/1970 | Kesler | 127/29 |
| 3,674,555 | 7/1972 | Meyer | 426/471 X |
| 3,716,408 | 2/1973 | Nagasawa | 127/29 X |
| 3,809,765 | 5/1974 | Bratland | 426/471 |
| 3,922,369 | 11/1975 | Glicksman | 426/548 |
| 3,956,521 | 5/1976 | Pisecky | 426/471 X |
| 4,099,982 | 7/1978 | Hansen | 426/471 X |
| 4,405,378 | 9/1983 | Kulprathipanja | 127/46.3 |

FOREIGN PATENT DOCUMENTS

| | | | |
|---|---|---|---|
| 2011257 | 9/1971 | Fed. Rep. of Germany | 426/471 |
| 355224 | 11/1972 | U.S.S.R. | 127/46.1 |

OTHER PUBLICATIONS

Spectroscopic Study of Calcium Complexes of Sucrose, Francotte et al., vol. 98, pp. 137–144, May 1979.

*Primary Examiner*—Kenneth M. Schor

*Attorney, Agent, or Firm*—Thomas R. Savoie; Thomas A. Marcoux; Daniel J. Donovan

[57] ABSTRACT

A method is provided for complexing low molecular weight saccharides with an inorganic anioncation complex so that the metallic cation of said complex causes the aggregation of the saccharides to form a complex. The complex is separated via spray drying with the resultant complex displaying a resistance to humidity and an increased flowability.

11 Claims, No Drawings

METHOD AND MANUFACTURE FOR EASILY SPRAY-DRIABLE LOW MOLECULAR WEIGHT SUGARS

The present invention deals generally with the spray drying of edible substances, and more particularly with an improved method for spray drying low molecular weight saccharides and high fructose corn syrups so as to achieve an essentially non-hygroscopic product.

In the manufacture of various comestible products the ingredients most often used therein are comprised of large amounts of diverse saccharides. These materials are usually introduced into the mix via on-line packaging machinery. In order for the filling or packaging machine to operate most efficiently, the dried mix or food product must flow therethrough with a minimal amount of supervision and alteration. After the dried mix is packaged the product is distributed, thereby introducing a second problem which must be promptly overcome. Upon standing and exposure to moisture, the sugar component of these mixtures often attracts water which in turn causes clumping, as the wetted sugar acts as a cement-making the product retained unacceptable to the consumer. There have been many attempts to deal with the hygroscopic nature of low molecular weight sugars with the most popular being avoidance. In addition, it has always been most desirous to somehow use high fructose corn syrup in a dry form to incorporate what was once a syrup into a dry-mix formulation. There have been many agents that have been combined with said sugars to overcome the saccharides' hygroscopic nature prior to packaging, but essentially the hydrophilic qualities which characterize sugars as a class, stands unchallenged.

Attempts to spray dry such low molecular weight sugars as fructose, glucose or syrups such as high fructose corn syrups, having a dextrose equivalent (D.E.) of from about 36 to 100 thereby making said ingredients easier to handle within the packaging line, have resulted in dismal failure. Basically sugars are intractable to this method due to their hygroscopicity, and no matter what logistical modifications are made, methods such as spray drying wherein a dry form of the saccharide is achieved, are of no utility. As an example, the spray-drying of fructose, for instance, results in a product that turns into a gummy hygroscopic product or syrup, which cannot be introduced into a dry mix product. Therefore, there has been a long standing need to somehow modify the sugar so as to facilitate spray drying or other forms of regularizing the sugar particles. Of greater moment would be the ability to utilize high fructose corn syrup (HFCS) in a dry and easily manageable form; for its low price and organoleptic properties qualify this dextrin as a candidate of choice.

The prior art is essentially devoid of significant references drawn to the spray drying of low molecular weight sugars, and as a general rule, the spray drying of fructose of HFCS has been heretofore considered an insoluble conundrum. In fact, the major references speak to the formation of calcium-sugars in solution; said compounds being employed as intermediate products in the purification of low weight sugars.

SUMMARY OF INVENTION

Accordingly, the following method may be employed to prepare a spray-driable, non-hygroscopic fructose or high fructose corn syrup. An edible metal anion-cation such as calcium chloride, calcium hydroxide, calcium oxide is dissolved in an aqueous solution causing the disassociation of the cation from the salt moiety. To this aqueous solution, one or more low molecular weight sugars or (eg., high fructose corn syrup) are added therein so that it forms thereby a sugar cation complex.

The dissolved cation complex is then atomized via a nozzle of high pressure and low capacity so that a fine spray evolves. The atomized solution is introduced into a spray drying tower wherein a current of hot air is fed upwards or downwards so that said atomized solution is dried. The dried cation-sugar complex is then collected and may be directly incorporated into existing comestible mixes. The dried product is essentially non-hygroscopic and therefore is impervious to ambient humidity.

DETAILED DESCRIPTION OF PREFERRED EMBODIMENT

The preferred procedure, for the manufacture of the cation-sugar complex is outlined hereinbelow. The first step is to dissolve a predetermined amount of an anion-cation compound, an amount effective for raising the pH of the solution to an alkaline value, in an aqueous system. The number of cation complexes which may be used for this purpose is essentially unlimited. For example, not only may essentially basic cation compounds be utilized, but also cation salts with adequate amounts of inorganic or organic bases may be used so that an alkaline pH of an aqueous system results. Therefore aluminum chloride, calcium chloride and sodium hydroxide in amounts adequate to raise the pH of the solution to at least 9 may be used to generate liberated trivalent, divalent and monovalent cation radicals in solution.

The next step is to add the sugar to the solution. The sugar may be a monosaccharide, disaccharide or combinations of same, allowing both large and small dextrin molecules or various weight corn syrups to be reacted thereby. More specifically, and for the purposes of this invention, such low molecular weight sugars as fructose, glucose or HFCS may be adaptively substituted therefore. Parenthetically, it is important to note that such low molecular weight sugars as those mentioned above, have not heretofore been amenable to spray drying. The normal state for these low molecular weight saccharides is as a syrup, since these molecules are highly hygroscopic and actively assimilate molecules of water which hang suspended in ambient humidity.

The low molecular weight saccharide is then added to the solution of liberated cations at a molar ratio of from 0.25 to 1.5 moles of cation to each mole of saccharide. The interreaction that takes place when the saccharide is placed in the alkaline solution, appears to be the following. The saccharide, which is a weak acid, is induced to ionize, so as to react to the basic solution in an effort to neutralize said solution. Therefore, the saccharide will tend to relinquish hydrogen ($H^+$) ions. The active site for the removal of $H^+$ ions appears to be the hydroxyl ($OH^-$) groups of the sugar. With the liberation of the hydrogen of the hydroxyl groups of the sugar, the $OH^-$ ions of the solution link with said hydrogen ions to form water (HOH), leaving the oxygen of the sugar essentially electron rich and active. Then, the calcium or other cation radical which has a net positive charge links with the oxygen of the sugar, said oxygen having a net negative charge thereby forming a complex. The complex is composed of a cation linked to one or more sugars. For example, a monovalent cation-like potassium (K) will link to one sugar or saccharide molecule. A divalent cation-like calcium will link at least two saccharide molecules and a trivalent cation like aluminum, will link up to three saccharide molecules. Therefore, a list of preferred cations follow; any of the complexes formed thereby may be operatively substituted. The preferred monovalent cations may be lithium (Li), sodium (Na), potassium (K), rubidium (Rb) or cesium (Cs), said monovalent cations linking a single saccharide. Preferred divalent cations, which will link two saccharides, include magnesium (Mg), calcium (Ca), zinc (Zn), strontium (Sr) and barium (Ba). Finally, preferred trivalent cations which are capable of joining three saccharide units embrace aluminum (Al), cerium (Ce) and lanthanum (La).

The threshold requirement is that the disassociated anion-cation compound is capable of raising the pH of the solution to a pH of at least 9. Therefore, not only are oxides, hydroxides and carbonates operatively effective, but also halide salts coupled with the above would yield the desired environment.

Reaction of the liberated cation radical with the saccharide produces a unique compound. When dissolved in the aqueous solution the low molecular weight saccharide-cation is soluble yet extrudable. Therefore, a method for separating the cation-sugar complex is necessary. A preferred method for separating said compound, is via spray drying. This procedure encourages the formation of spherical particles of uniform size. The rounded spherical particles may then be easily assimilated into the feed mechanism of existing machinery. The solution which contains the dissolved cation-saccharide is prepared for spray drying. By utilizing such spray drying equipment as Niro Atomizer, model Mobile Minor (Gladsaxevej 305, Soborg, Copenhagen, Denmark), the spray drying procedure may be effected thereby.

Spray-drying, as accomplished by a spray drying apparatus as that which is mentioned hereinabove, is achieved via the following steps. Atomization of the solution allows the low molecular weight saccharide-cation complex to be disposed so as to include many such individual compounds within a single droplet. With an inlet or updraft temperature of about 120° C., the atomized cation-saccharide complex is sprayed into the drying tower. The atomized droplets are dried thereby forming rounded spheres, which drop to the bottom of the tower so that a unique dried complex collects.

The newly formed complex in solution permits spray drying of a heretofore unspraydryable saccharide. For example, fructose in an unmodified state attracts water and holds this water in a "bound state". This attraction of and retention of water increases the difficulty of spray drying the compound. The additon of the cation to the saccharide to form the complex permits the low molecular weight saccharide to be spray dried. It appears that the complex which is formed by the addition of a cation to a low molecular weight saccharide modifies the osmotic pressure of the sugar to encourage release of the bound water so that water that was once in a bound state is now in a free state. Therefore a principle advantage of the present invention is that a relatively small amount of energy would be needed to dry the cation saccharide complex. Moreover, once this complex is formed, isolated, and dried, it is essentially non-hygroscopic and does not present the same hydrophilic properties that fructose or glucose or other low molecular weight sugars possess.

The newly formed cation-low molecular weight saccharide complex displays unusual qualities that neither the unreacted low molecular weight saccharide or other sugars as a class display. For example, the osmotic pressure of the newly formed complex, that is, a measurement of the number of ions or molecules in solution, is radically different in the reacted complex from the unreacted sugar. Practically, the result is that the sugar cation complex may be easily spray dried at a temperature far lower than those temperatures that heretofore have been used and, in the case of fructose, glucose or HFCS, allows the saccharide to be spray dried. Depending on the cation ratio the spray drying temperature may be depressed 15° or 20° C. with minute changes in osmolarity of the solution. This phenomenon is described hereinbelow.

Another advantage of the newly formed complex is that the complex does not depress the freezing point of a given solution as would unreacted fructose or other low molecular weight sugars would.

Therefore, the complex may be utilized in frozen products where a depression of the freezing point is undesirable. In addition, the present invention advantageously allows the user to handle such unmanageable products as high fructose corn syrup, an admixture of low molecular weight saccharides, so as to incorporate this ingredient into existing dry product mixes. By complexing a cation with high fructose corn syrup, what was once a syrupy, hygroscopic viscous liquid, may be so modified into a free flowing powder. The ramifications of this advance are clear. Commercially, one may take a lower priced raw material which is hygroscopic and prepare a much more desirably economic raw product for immediate use or for extended storage.

The thermal characteristics which the complex according to the above enumerated process displays is idiosyncratic and reflects the modification which the saccharide has undergone. Unlike fructose or glucose which form syrups at room temperature and ambient humidity, fructose-cation or glucose-cation complexes are free-flowing powders. These compounds also exhibit a defined melting point. As a complex composed of one or more cation-saccharide units, the newly formed complex displays melting point characteristics which are characteristic of amorphous, pseudo-polymeric structures. For example, unmodified fructose has a melting point of 104° F. When calcium cation is added to thereby link one or more saccharide units, the resulting complex has a melting point of about 180° F. Moreover, by using thermal analysis [Dupont 1090 DSC unit manufactured by Dupont Instruments Division, Wilmington, Del.] one may readily see the amorphous compound crystallize and then melt; the reaction being characterized by an exothermic peak and being characteristic of polymeric substances.

EXAMPLE 1

To 98.76 g of a 30% (w/w) solution of high fructose corn syrup (HFCS) having a composition of 71% solids of which 52% was glucose, 42% fructose and 6% higher saccharides, was added 1.24 g CaO which had previously been dried at 400° C. for ½ hour. If one assumes that the 96% of the solids in the HFCS have the molecular weight of fructose, the molar ratio of calcium to monomeric sugar in the solution was 0.2. The resulting solution was translucent and had a pH of about 11.

The solution was then sprayed into hot air of temperature 185° C. The spray-dried product was collected as a free-flowing fine powder, but the powder was hygroscopic and picked up moisture from the air.

EXAMPLE 2

To the 96.89 g of the HFCS solution of Example 1 was added 3.11 g of the CaO. This solution also was translucent, had a pH of 12 and a molar ratio of $Ca^{++}$/sugar=0.5. When sprayed into 185° C. air, the resulting powder was free-flowing and non-hygroscopic even when left exposed to the air.

EXAMPLE 3

To 98.4 g of the HFCS solution of Example 1 was added 1.56 g of the CaO. The solution was translucent also had a pH of 12, but had a molar ratio of $Ca^{++}$/sugar=0.25. When sprayed into 185° C. air, the rsulting powder was free-flowing and non-hygroscopic.

EXAMPLE 4

When the Ca-HFCS solution of Example 2 was sprayed into air of temperature 160° C., the resulting powder was identical to that of Example 2, indicating that lower spray drying temperatures were feasible.

EXAMPLE 5

To 96.7 g of the Ca-HFCS solution of Example 1 was added 3.3 g of the 5M NaOH. The resulting solution was translucent but had a pH of about 12. The solution was spray-dried as above and the resulting powder was free flowing and non-hygroscopic.

EXAMPLE 6

To 97.7 g of the HFCS solution of Example 1 was added 2.22 g NaOH. The resulting solution had a molar ratio of $Na^{+}$/sugar=0.5. When sprayed into 185° air, the resulting powder was free flowing and non-hygroscopic.

EXAMPLE 7

To 96.89 g of the HFCS solution of Example 1 was added 3.11 g of KOH to make the solution have a molar ratio of $K^{+}$/sugar=0.5. When sprayed into 185° air, the resulting powder was free flowing and just slightly hygroscopic. Increasing the amount of KOH did not decrease the powder's hygroscopicity.

From the examples, it is clear that the material remains as a free flowing powder when exposed to air at ambient moisture and temperature.

Therefore, while the instant invention is described with reference to low molecular weight saccharides and high fructose corn syrups, other saccharides and other comestible components may be substituted bring them within the purvicio and spirit of the claims.

We claim:

1. The method for producing spray-dried, low-molecular-weight sugar powders comprising the steps of:

(a) forming an aqueous solution comprised of a metal cation-containing compound and low-molecular-weight sugars selected from the group consisting of fructose, glucose, corn syrups having a D.E. of from 36 to 100 and combinations thereof, said low-molecular-weight sugars being substantially the only saccharides in the solution, said compound being present in an amount which raises the pH of the solution to at least 9.0 and wherein the molar ratio of metal cation to saccharide is from about 0° to 1.5:1, (b) forming a cation-sugar complex in said solution; and then (c) spray-drying the solution to obtain a cation-sugar complex-containing powder which complex is composed of a cation linked to one or more sugars and which powder remains free-flowing upon exposure to ambient conditions.

2. A method according to claim 1 wherein the metal cation-containing compound is an oxide, a hydroxide or a carbonate.

3. A method according to claim 2 wherein the metal cation is a monovalent cation.

4. A method according to claim 2 wherein the metal cation is a divalent cation.

5. A method according to claim 4 wherein the cation is calcium.

6. A method according to claim 1 wherein the compound is calcium oxide.

7. A method according to claim 1 wherein the compound is sodium hydroxide.

8. A method according to claim 1 wherein the compound is potassium hydroxide.

9. A method according to claim 2 wherein the solution formed in step (a) consists of water, metal-cation containing compounds, and said low-molecular-weight sugars.

10. A method according to claim 2 wherein the metal cation is selected from the group consisting of Li, Na, K, Rb, Cs and combinations thereof.

11. A method according to claim 2 wherein a divalent cation is selected from the group consisting of Mg, Ca, Sr, Zn, Ba and combinations thereof.

* * * * *

UNITED STATES PATENT OFFICE

CERTIFICATE OF CORRECTION

Patent No. 4,541,873 Dated Sept. 17, 1985

Inventor(s) Schenz et al.

It is certified that error appears in the above-identified patent and that said Letters Patent are hereby corrected as shown below:

Claim 1 line 17 change "0°" to --0.25--

Signed and Sealed this

*Thirteenth* Day of *May 1986*

[SEAL]

*Attest:*

DONALD J. QUIGG

*Attesting Officer*

*Commissioner of Patents and Trademarks*